United States Patent [19]

Lecinski, Jr.

[11] 4,444,325

[45] Apr. 24, 1984

[54] CLOSURE AND PRY-OFF RESEALABLE FINISH

[75] Inventor: Frank H. Lecinski, Jr., Harwood Heights, Ill.

[73] Assignee: Continental White Cap, Inc., Northbrook, Ill.

[21] Appl. No.: 402,454

[22] Filed: Jul. 27, 1982

[51] Int. Cl.[3] ..... B65D 41/22

[52] U.S. Cl. ..... 215/31; 215/346

[58] Field of Search ..... 215/31, 346

[56] References Cited

U.S. PATENT DOCUMENTS

| | | | |
|---|---|---|---|
| 2,633,262 | 3/1953 | Acton | 215/346 |
| 2,670,868 | 3/1954 | Stover et al. | 215/31 |
| 2,817,453 | 12/1957 | Stover | 215/346 X |
| 2,990,076 | 6/1961 | Stull | 215/31 |
| 3,690,497 | 9/1972 | Lecinski | 215/346 X |

FOREIGN PATENT DOCUMENTS

| | | |
|---|---|---|
| 295164 | 8/1928 | United Kingdom . |
| 296645 | 9/1928 | United Kingdom . |
| 404592 | 1/1934 | United Kingdom . |
| 471119 | 8/1937 | United Kingdom . |
| 525891 | 9/1940 | United Kingdom . |
| 672109 | 5/1952 | United Kingdom . |

*Primary Examiner*—Donald F. Norton

*Attorney, Agent, or Firm*—Charles E. Brown

[57] ABSTRACT

This relates to a container neck finish which is particularly constructed to have an interlock with a closure of the pry-off type. The container neck finish has a peripherally projecting locking bead which includes an upper camming surface and a lower locking surface, and the associated closure has within the skirt thereof an extension of the usual gasket or sealing liner wherein, when the closure is applied to the neck finish locking bead, will deform the adjacent portion of the liner and form an interlock therewith which serves to retain the closure in place. The interlock permits the prying off of the closure and will serve again to retain the closure in place for the purpose of maintaining the original seal when the closure is reapplied.

8 Claims, 3 Drawing Figures

CLOSURE AND PRY-OFF RESEALABLE FINISH

Figure 1:
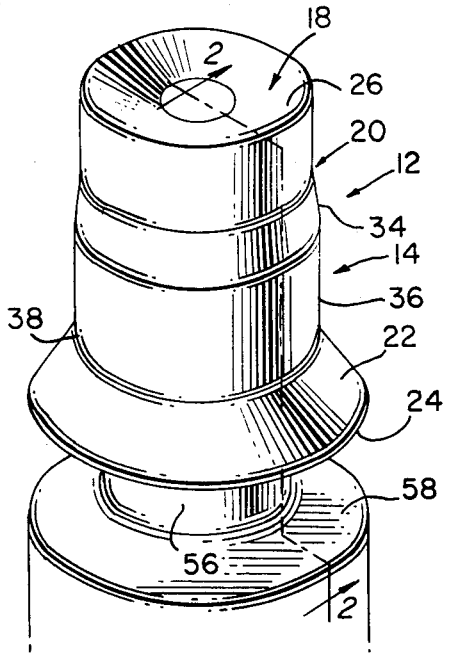

This invention relates in general to new and useful improvements in containers, and more specifically to the sealing of containers utilizing removable and replaceable closures. This invention most particularly relates to the neck finish of a container which is preferably formed of glass, the neck finish being such that a closure may have the gasket or sealing liner thereof interlocked with the neck finish to retain the closure in place and to facilitate the replacement of the closure and the resealing of the container.

This invention particularly relates to a closure of the type wherein the closure must be pried off of the container.

In accordance with this invention, the container neck finish is provided at the extreme end thereof with an end surface for sealing engagement with the gasket or sealing liner of a closure. The neck finish differs from other neck finishes in that axially spaced below the end surface the outer surface of the neck finish is provided with a locking bead which projects radially outwardly from the general contour of the neck finish. This locking bead is particularly configurated and positioned for seating in and interlocking with a tubular portion of the closure liner which extends down generally in the skirt area of the closure.

The locking bead is generally wedge-shaped and the peripheral size of the exterior surface of the neck finish above the locking bead is greater than that of the external surface of the neck finish below the locking bead, and the locking bead is so tilted or cross sectioned so that it includes an upper camming surface which is at a slight angle to the vertical and a lower locking surface which is at a slight angle to the horizontal and which lower locking surface extends further inwardly of the outer periphery of the neck finish than does the camming surface.

In accordance with this invention, a closure having a gasket or sealing liner which includes an upper horizontal portion and a vertical tubular portion is applied over the neck finish and forced downwardly so that the upper horizontal portion forms a seal with the end sealing surface of the neck finish and the tubular portion of the liner is cammed over the neck finish locking bed and, after a momentary seating, the locking bead will be firmly embedded within the liner tubular portion so as to retain the closure in place on the neck finish.

The container is preferably of the vacuum pack type, although the invention is not so limited. The closure must be pried off of the container even when the closure is initially primarily retained in place by the vacuum within the container, the interlock between the locking bead and the closure liner serves to permit the reclosing of the container and the holding of the closure liner in tight sealed engagement with the end sealing surface of the neck finish.

With the above and other objects in view that will hereinafter appear, the nature of the invention will be more clearly understood by reference to the following detailed description, the appended claims, and the several views illustrated in the accompanying drawings.

IN THE DRAWINGS

Figure 2:
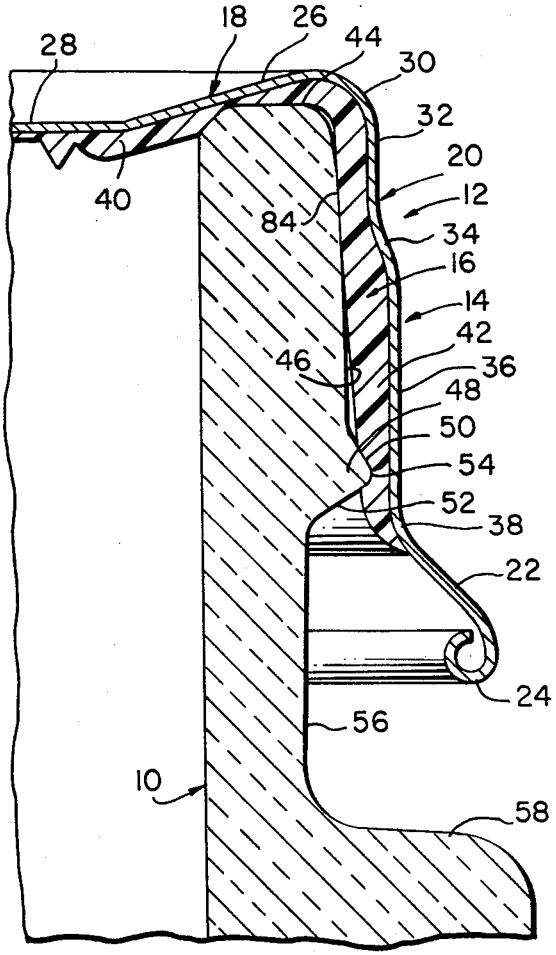

FIG. 1 is a fragmentary top perspective view of a container formed in accordance with this invention and closed by way of a closure applied thereto. FIG. 2 is an enlarged fragmentary sectional view taken generally along the line 2—2 of FIG. 1, and shows the specific configuration of the container neck finish and the manner in which the closure is sealed relative to the neck finish and locked in place thereon.

Figure 3:
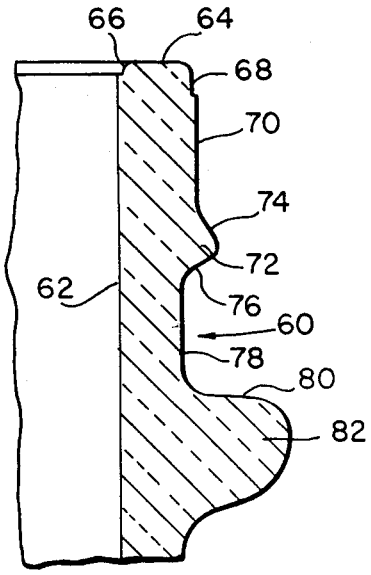

FIG. 3 is an enlarged fragmentary sectional view taken through a slightly modified and preferred embodiment of a container neck finish.

Referring now to the drawings in detail, it will be seen that there is illustrated in FIG. 1 the upper portion only of a container which is preferably in the form of a glass jar or bottle, but which could feasibly be formed of a suitable plastic material. The container is generally identified by the numeral 10 and is closed by means of a closure 12.

This invention primarily relates to the details of the neck finish of the container 10 and its relationship to the closure 12.

Referring now to FIG. 2 in particular, it is first to be noted that the closure 12 includes a cup or shell 14 having molded therein a liner 16. The cup or shell 14 is preferably formed of metal, although it is feasible to form the same of a suitable plastic material.

The cup or shell 14 basically includes an end wall 18 and a skirt 20 with the skirt 20 terminating in a radially outwardly directed lower flange portion 22 which, in turn, terminates in an inwardly turned curl 24.

The end wall or top 18 of the closure 12 has an outer portion 26 which slopes downwardly and inwardly and terminates generally in a central panel portion 28. The outer portion 26 is joined by a radius 30 to a cylindrical upper portion 32 of the skirt 20. The skirt 20 is outwardly flared as at 34 and has a lower portion 36 of a larger diameter than the upper portion 32. The skirt lower portion 36 is connected to the flange 22 by a radius 38.

The liner 16 includes a generally horizontal upper portion 40 which is preferably annular and does not fully cover the underside of the top wall 18. The liner 16 also includes a generally cylindrical vertical portion 42 which is molded within the skirt 20.

As stated above, the invention resides primarily in the configuration of the neck finish of the container 10. The neck finish includes a terminal or end sealing surface 44 and the upper exterior surface of the neck finish is generally cylindrical and is identified by the numeral 46. The neck finish has below the exterior surface 46 a radially outwardly directed locking bead 48 which includes an upper inwardly and outwardly sloping camming surface 50 and a lower downwardly and inwardly sloping surface 52, the surfaces 50 and 52 being joined together by a small diameter radius 54. Below the locking bead 48 the neck finish includes a further exterior surface 56 which is also generally cylindrical and of a lesser diameter than the surface portion 46. Thus, the locking surface 52 extends radially inwardly further than the camming surface 50.

Below the exterior surface portion 56, the neck finish slopes generally horizontally radially outwardly to define a pry-off shoulder 58. It will be seen that the shoulder 58 underlies the curl 24 and is spaced therebelow a distance such that a suitable tool or coin may be inserted between the shoulder 58 and the curl 24 to urge the closure 12 upwardly relative to the container neck finish to a released position even if the container is vacuum packed and there is a vacuum within the container which serves to assist in the holding of the closure in place.

It will be readily apparent from FIG. 2 that the locking bead 48 becomes embedded in the liner tubular portion 42 such that the liner becomes interlocked with the neck finish. Thus, the closure 12 is retained in place on the container 10 by the interlock between the locking bead 48 and the liner 16.

After the container 10 is initially opened and the seal between the liner and the end surface 44 is broken, after partial dispensing of the product from the container 10, the closure 12 may be reapplied and when pressed into place restoring the closure to its original position, the liner portion 42 will again interlock with the locking bead 48 and serve to hold the liner portion 40 in tight sealed engagement with the sealing end surface 44.

Reference is now made to FIG. 3 wherein there is illustrated a preferred embodiment of the container neck finish, the container neck finish being generally identified by the numeral 60. The container neck finish 60 includes an inner cylindrical throat 62 and terminates in an end sealing surface 64 similar to the end sealing surface 44. The upper inner part of the neck finish is notched as at 66 so as clearly to define an end sealing surface having required corners both interiorly and exteriorly.

The upper exterior surface portion of the neck finish 60 is also radially inwardly recessed as at 68 so as to provide a stepped upper exterior surface which also includes a lower cylindrical portion 70. At the lower end of the exterior surface portion 70 is a locking bead 72 which corresponds to the locking bead 48. The locking bead 72 has an upper camming surface 74 which slopes at an angle to the vertical on the order of 30°. The locking bead 72 also includes a lower locking surface 76 which slopes at an angle to the vertical on the order of 60°. The lower locking surface 76 terminates in an outer peripheral surface portion 78 which is of a lesser diameter than the surface portion 70 so that the lower locking surrace 76 extends radially inwardly beyond the upper camming surface 74.

The neck finish 60 below the peripheral surface portion 78 is in the form of a pry-off shoulder 80 which may be in the form of a projecting bead 82 or may be part of an enlargement of the neck finish.

It is to be noted that the closure 12 of FIG. 2 or a similar closure will interlock with the neck finish 60 to form the desired seals. At this time it is pointed out that it may be desirable under certain circumstances for the liner tubular portion 42 to have an upper portion thereof in cylindrical sealing contact with the upper neck finish outer surface portion as shown at 84 in FIG. 2.

Although only a preferred embodiment of the invention has been specifically illustrated and described herein, it is to be understood that minor variations may be made in the neck finish and its relationship to the closure without departing from the spirit and scope of the invention as defined by the appended claims.

I claim:

1. A container neck finish for receiving in pry-off relation a closure which may be resealed with said neck finish, said neck finish providing an end surface for sealing engagement by a closure, and axially below said end surface in remote spaced relation a radially outwardly projecting locking bead for locking engagement by a closure to retain such closure on said neck finish, said locking bead being spaced from said end surface by an axially elongated cylindrical surface, and the peripheral size of the exterior of said neck finish above said locking bead being greater than the peripheral size of the exterior of said neck finish below said locking bead with an upper surface of said locking bead being a camming surface and a lower surface of said locking bead being a locking surface.

2. A container neck finish according to claim 1 wherein said locking bead is essentially wedge shaped in cross section and has substantially flat upper and lower surfaces.

3. A container neck finish for receiving in pry-off relation a closure which may be resealed with said neck finish, said neck finish providing an end surface for sealing engagement by a closure, and axially below said end surface in remote spaced relation a radially outwardly projecting locking bead for locking engagement by a closure to retain such closure on said neck finish, said locking bead being spaced from said end surface by an axially elongated cylindrical surface, and said locking bead being essentially wedge shaped in cross section and having substantially flat upper and lower surfaces.

4. A container neck finish according to claim 3 wherein said flat upper and lower surfaces define an included angle on the order of 90°.

5. A container neck finish according to claim 3 wherein said flat upper and lower surfaces define an included angle on the order of 90°, said flat upper surface being at a shallow angle to the vertical and said flat lower surface being at a shallow angle to the horizontal.

6. A container neck finish for receiving in pry-off relation a closure which may be resealed with said neck finish, said neck finish providing an end surface for sealing engagement by a closure, and axially below said end surface in remote spaced relation a radially outwardly projecting locking bead for locking engagement by a closure to retain such closure on said neck finish, said locking bead being spaced from said end surface by an axially elongated cylindrical surface, and an applied closure, said closure being in the form of a shell having a gasket-like liner, said liner having an upper generally horizontal portion compressively engaging said end surface and an elongated vertical tubular portion in a lower portion of which said locking bead is embedded.

7. A container neck finish according to claim 6 wherein said shell and said liner vertical tubular portion flare radially outwardly below said locking bead.

8. A container neck finish according to claim 6 wherein said shell continues below said liner and terminates in a bead axially spaced from said liner vertical tubular portion.

* * * * *